US011011814B2

(12) United States Patent
Uemichi et al.

(10) Patent No.: US 11,011,814 B2
(45) Date of Patent: May 18, 2021

(54) COUPLING COMPRISING A CONDUCTIVE WIRE EMBEDDED IN A POST-WALL WAVEGUIDE AND EXTENDING INTO A HOLLOW TUBE WAVEGUIDE

(71) Applicant: Fujikura Ltd., Tokyo (JP)

(72) Inventors: Yusuke Uemichi, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 0 days.

(21) Appl. No.: 16/328,050

(22) PCT Filed: Aug. 8, 2017

(86) PCT No.: PCT/JP2017/028763
§ 371 (c)(1),
(2) Date: Feb. 25, 2019

(87) PCT Pub. No.: WO2018/037911
PCT Pub. Date: Mar. 1, 2018

(65) Prior Publication Data

US 2019/0207284 A1 Jul. 4, 2019

(30) Foreign Application Priority Data

Aug. 26, 2016 (JP) ..... JP2016-165771

(51) Int. Cl.
*H01P 3/12* (2006.01)
*H01P 5/08* (2006.01)
*H01P 5/02* (2006.01)

(52) U.S. Cl.
CPC ..... *H01P 3/121* (2013.01); *H01P 3/12* (2013.01); *H01P 5/024* (2013.01); *H01P 5/08* (2013.01); *H01P 5/082* (2013.01); *H01P 5/087* (2013.01)

(58) Field of Classification Search
CPC ..... H01P 3/121; H01P 5/087; H01P 5/082; H01P 5/024
(Continued)

(56) References Cited

U.S. PATENT DOCUMENTS 3,146,410 A 8/1964 Butler
4,463,324 A 7/1984 Rolfs
(Continued)

FOREIGN PATENT DOCUMENTS

CN 1360742 A 7/2002
EP 0883328 A1 12/1998
(Continued)

OTHER PUBLICATIONS

Notice of Allowance in Japanese dated Apr. 4, 2017, issued in counterpart Japanese Patent Application No. 2016-165771, (3 pages).

*Primary Examiner* — Benny T Lee
(74) *Attorney, Agent, or Firm* — Westerman, Hattori, Daniels & Adrian, LLP

(57) ABSTRACT

A transmission line includes a post-wall waveguide which includes a dielectric substrate on which a pair of post-walls is formed and a first conductor layer and a second conductor layer opposed to each other with the dielectric substrate interposed therebetween and in which a region surrounded by the pair of post-walls, the first conductor layer, and the second conductor layer is a waveguide region, a waveguide tube having a hollow rectangular shape, being connected with the first conductor layer so as to cover an opening portion formed in a side wall, and in which an inside communicates with the waveguide region through an opening formed in the first conductor layer, and a wire member which is arranged such that through the opening, a first end is located inside the dielectric substrate and a second end is located in the waveguide tube.

3 Claims, 9 Drawing Sheets

(58) Field of Classification Search
USPC ..... 333/24 R, 248
See application file for complete search history.

(56) References Cited

U.S. PATENT DOCUMENTS

| | | | | |
|---|---|---|---|---|
| 5,982,256 | A * | 11/1999 | Uchimura et al. ..... | H01P 1/047 333/239 |
| 8,598,961 | B2 * | 12/2013 | Hasselblad et al. .... | H01P 1/025 333/21 R |
| 2006/0274992 | A1 | 12/2006 | Shimura et al. | |
| 2009/0000106 | A1 | 1/2009 | Chuang et al. | |
| 2011/0037531 | A1 | 2/2011 | Hasselblad et al. | |

FOREIGN PATENT DOCUMENTS

| | | | |
|---|---|---|---|
| EP | 1691444 | A1 | 8/2006 |
| GB | 2497982 | A | 7/2013 |
| JP | 4-358405 | A | 12/1992 |
| JP | 3464104 | B2 | 11/2003 |
| JP | 4395103 | B2 | 1/2010 |
| JP | 4677944 | B2 | 4/2011 |
| JP | 2012-195757 | A | 10/2012 |
| JP | 2014-236291 | A | 12/2014 |
| JP | 2015-80100 | A | 4/2015 |
| JP | 2015-80101 | A | 4/2015 |
| JP | 2015-226109 | A | 12/2015 |
| JP | 5885775 | B2 | 3/2016 |
| JP | 2016-149755 | A | 8/2016 |
| WO | 2012/140422 | A1 | 10/2012 |

* cited by examiner

COUPLING COMPRISING A CONDUCTIVE WIRE EMBEDDED IN A POST-WALL WAVEGUIDE AND EXTENDING INTO A HOLLOW TUBE WAVEGUIDE

TECHNICAL FIELD

Cross Reference to Related Application

The present application claims priority based on Japanese patent application 2016-165771, filed on Aug. 26, 2016 and the contents of which are incorporated herein by reference.

The present invention relates to a transmission line.

BACKGROUND ART

Conventionally, a waveguide tube is used as a transmission line for transmitting a high-frequency signal in the microwave band (0.3 to 30 [GHz]) to the millimeter wave band (30 to 300 [GHz]). In recent years, a post-wall waveguide (PWW) has also been used as a transmission line for transmitting such a high-frequency signal. The post-wall waveguide is a square-shape waveguide formed by a pair of conductor layers formed on both surfaces of a dielectric substrate and a pair of post-walls formed by arranging a plurality of conductor posts to penetrate the dielectric substrate in two rows.

The above-mentioned waveguide tube and post-wall waveguide may be used singly; however, they may be used in combination. For example, in a communication module, a transmission line in which a waveguide tube and a post-wall waveguide are combined is used as a transmission line between a transmission-reception circuit and an antenna. In such a communication module, for example, the high-frequency signal output from the transmission-reception circuit is transmitted to the waveguide tube after being transmitted by the post-wall waveguide, and being transmitted from the antenna after being transmitted by the waveguide tube.

The following Patent Documents 1 to 7 disclose a conventional transmission line in which transmission lines of different types are combined. For example, the following Patent Documents 1 to 5 disclose a conventional transmission line in which a waveguide tube and a post-wall waveguide are combined. The following Patent Document 6 discloses a conventional transmission line in which a waveguide tube and a print circuit board are combined. The following Patent Document 7 discloses a conventional transmission line in which a microstrip line and a post-wall waveguide are combined.

PRIOR ART DOCUMENTS

Patent Documents

[Patent Document 1] Japanese Patent No. 5885775 (published Mar. 15, 2016)

[Patent Document 2] Japanese Unexamined Patent Application, First Publication No. 2015-80100 (published Apr. 23, 2015)

[Patent Document 3] Japanese Unexamined Patent Application, First Publication No. 2015-226109 (published Dec. 14, 2015)

[Patent Document 4] Japanese Unexamined Patent Application, First Publication No. 2012-195757 (published Oct. 11, 2012)

[Patent Document 5] Japanese Patent No. 4395103 (published Jan. 6, 2010)

[Patent Document 6] Japanese Patent No. 4677944 (published Apr. 27, 2011)

[Patent Document 7] Japanese Patent No. 3464104 (published Nov. 5, 2003)

SUMMARY DISCLOSURE OF THE INVENTION

Problems to be Solved by the Invention

In recent years, communication arrangements using the E band (70 to 90 GHz-band) has attracted attention. In such communication, in a common port (antenna connection terminal) of, for example, a diplexer (a three-port filter element that is connected to an antenna and separates two frequency ranges), a broadband high-frequency signal of 71 to 86 GHz-band is input and output. Therefore, the transmission line for transmitting such a high-frequency signal is required to have low reflection loss (for example, the reflection loss is −15 [dB] or less) over a wide band of 71 to 86 GHz-band.

Here, for example, in a transmission line (a transmission line in which a waveguide tube and a post-wall waveguide are combined) disclosed in Patent Document 1 described above, the band in which the reflection loss is low is, for example, 57 to 67 GHz-band. As described above, in the transmission line disclosed in Patent Document 1 described above, the band where the reflection loss is low is approximately 10 [GHz], and when the high-frequency signal over the wide band range of the above-mentioned 71 to 86 GHz-band is transmitted, there is a problem in that the band width is insufficient.

In the transmission line disclosed in Patent Document 1 described above, a waveguide tube is vertically attached to a dielectric substrate constituting a post-wall waveguide, and between the post-wall waveguide and the waveguide tube, the transmission directions of the high-frequency signals are orthogonal to each other. Therefore, in the transmission line disclosed in Patent Document 1 described above, for example, when an external force is applied to the waveguide tube, moment of force is generated and a large force acts on the installation position of the waveguide tube with respect to the post-wall waveguide. When the dielectric substrate forming the post-wall waveguide is formed of a brittle material such as glass, there is an issue in terms of strength.

The present invention has been made in view of the above circumstances, and provides a strong transmission line having low reflection loss over a wide band.

Means for Solving the Problems

A transmission line according to one aspect of the present invention includes a post-wall waveguide which includes a dielectric substrate on which a pair of post-walls is formed and a first conductor layer and a second conductor layer opposed to each other with the dielectric substrate interposed therebetween and in which a region surrounded by the pair of post-walls, the first conductor layer, and the second conductor layer is a waveguide region, a waveguide tube having a hollow rectangular shape, being connected with the first conductor layer so as to cover an opening portion formed in a side wall, and in which an inside of the waveguide tube communicates with the waveguide region through an opening formed in the first conductor layer, and a wire member which is arranged such that through the opening, a first end is located inside the dielectric substrate and a second end is located in the waveguide tube.

In the aspect described above, the wire member may be inserted into a hole formed from the opening side to a part of the dielectric substrate.

In the aspect described above, a conductor film having a bottomed cylindrical shape may be formed along the inner wall of the hole, and the wire member may be inserted through the hole in which the conductor film is formed.

In the aspect described above, a land having a larger diameter than the wire member may be formed around the wire member in the same plane as the first conductor layer, and an anti-pad may be formed between the first conductor layer and the land.

In the aspect described above, at least in one of the first end side and the second end side of the wire member, a diameter may gradually decrease toward the distal end.

In the aspect described above, an axial direction of the waveguide tube may be the same direction as a direction in which the waveguide region of the post-wall waveguide extends.

Effects of the Invention

According to the above aspects of the present invention, the inside of the waveguide tube and the waveguide region of the post-wall waveguide communicate with each other through an opening formed in the first conductor layer of the post-wall waveguide. Through the opening, the wire member is arranged such that one end (first end) is located inside the dielectric substrate and the other end (second end) is located inside the waveguide tube. As a result, it is possible to obtain a strong transmission line having low reflection loss over a wide band.

DETAILED DESCRIPTION OF THE EMBODIMENTS OF THE INVENTION

Figure 1:
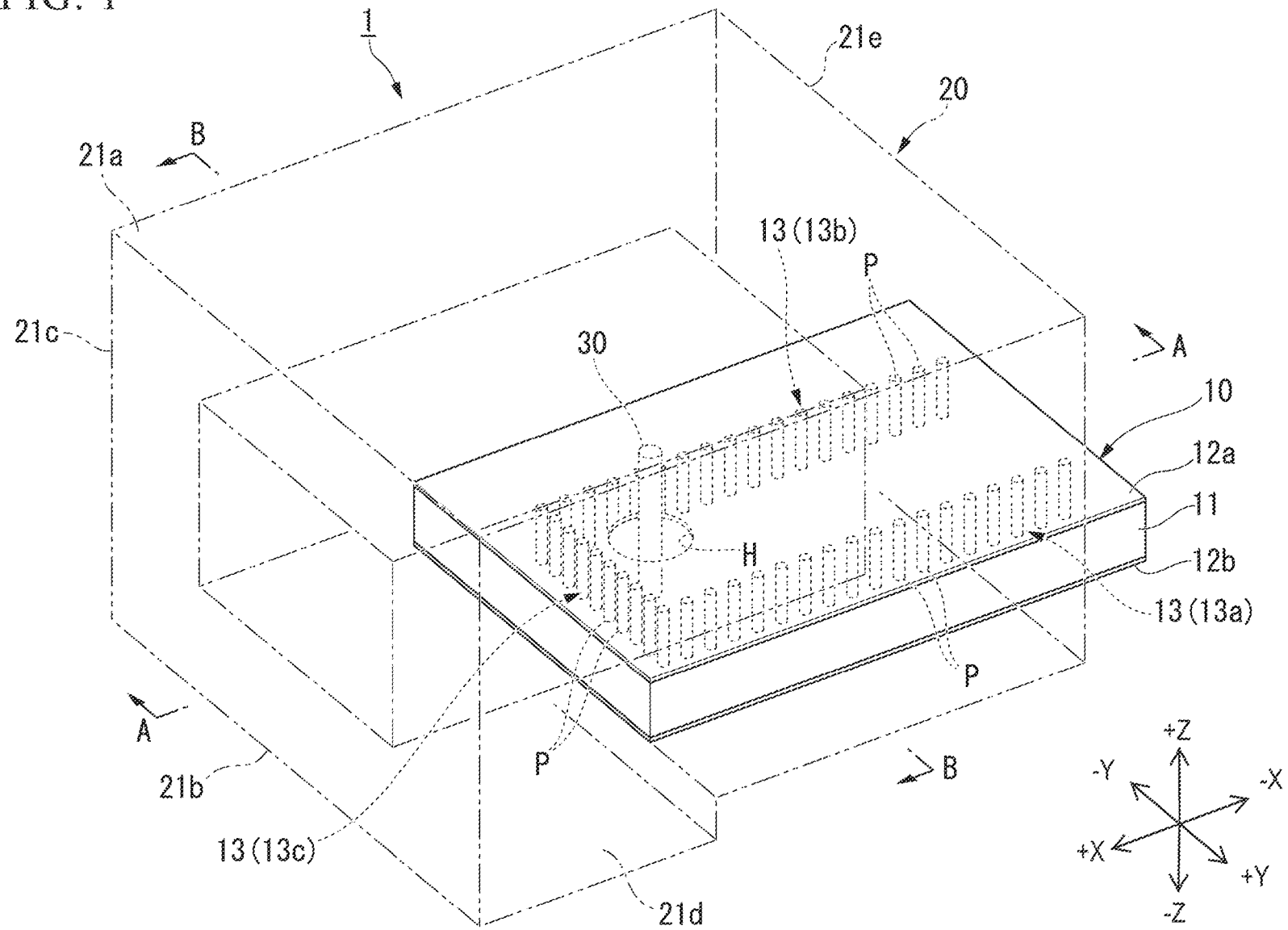
FIG. 1 is a perspective view showing a configuration of a main portion of a transmission line according to an embodiment of the present invention.

Hereinafter, a transmission line according to an embodiment of the present invention will be described in detail with reference to the drawings where the same members throughout the drawings are denoted by the same reference numerals and descriptions thereof may be omitted in certain circumstances. In the following descriptions, for ease of understanding, the positional relationship of each member will be described while referring to the XYZ orthogonal coordinate system (the position of the origin is appropriately changed) set in the drawings as necessary. In addition, in the drawings referred to below, for ease of understanding, dimensions of each member are appropriately changed and shown as necessary.

Figure 2:
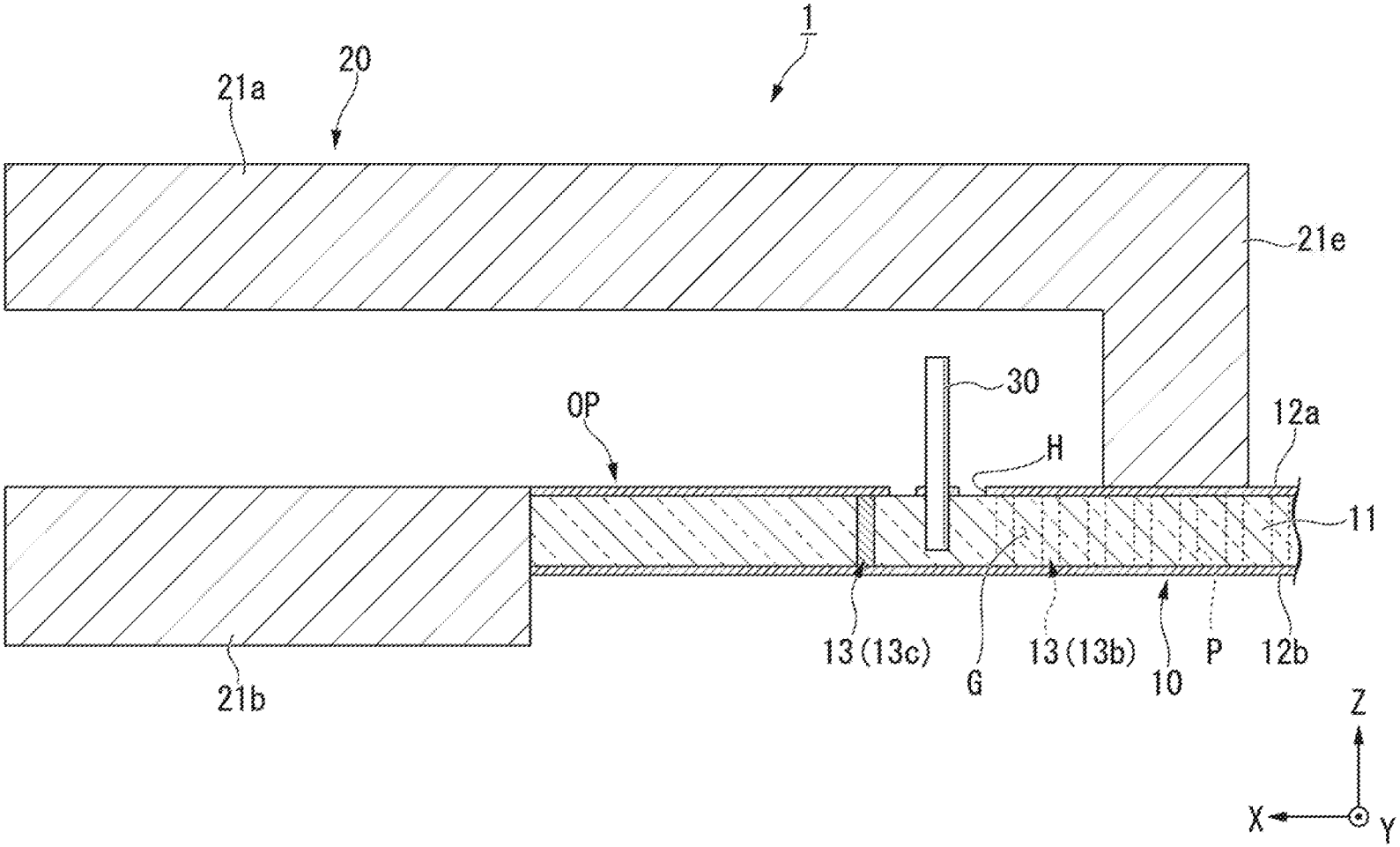
FIG. 2 is a cross-sectional view taken along a line A-A in FIG. 1.
Figure 3:
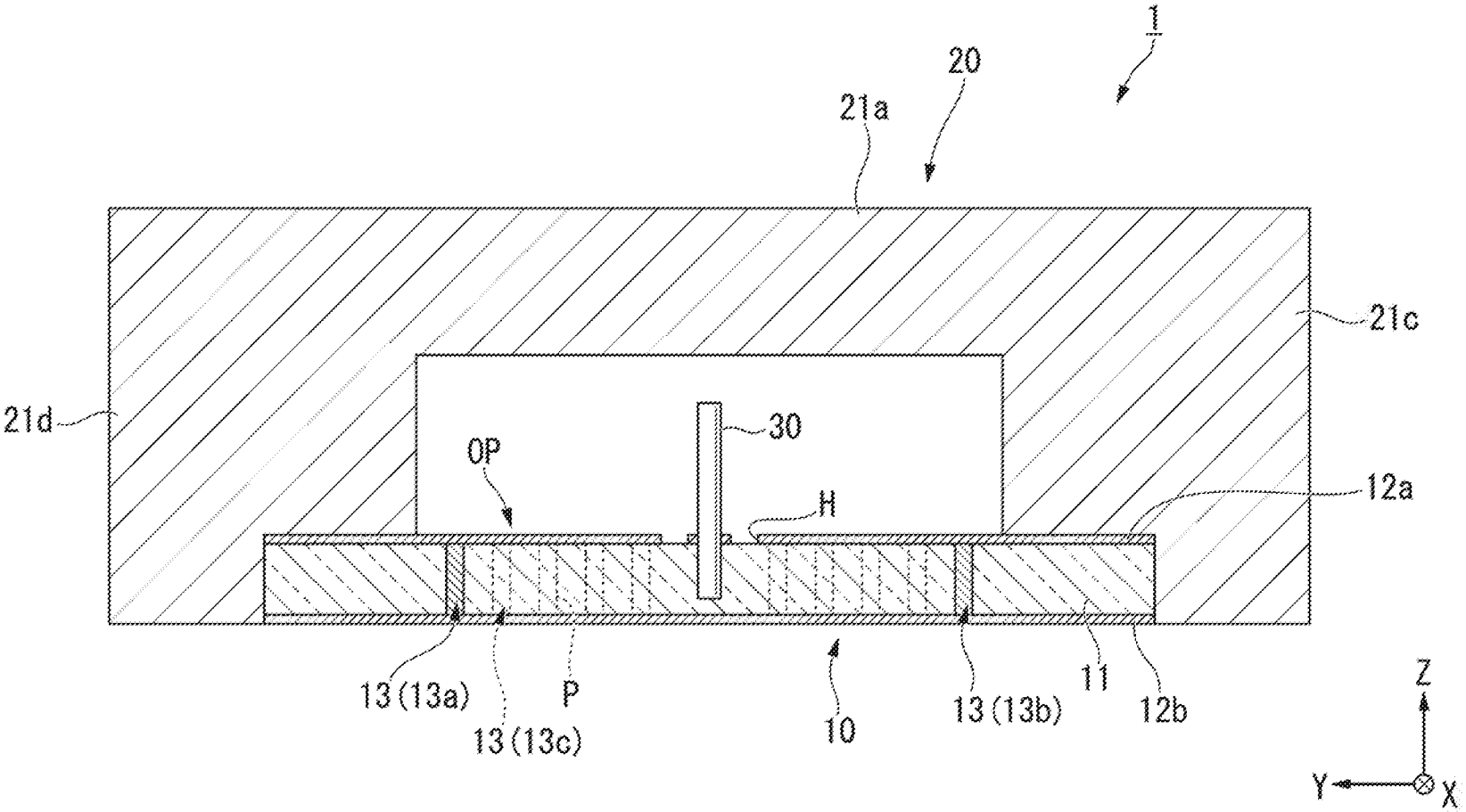
FIG. 3 is a cross-sectional view taken along a line B-B in FIG. 1.

FIG. 1 is a perspective view showing a configuration of a main portion of a transmission line according to an embodiment of the present invention. FIG. 2 is a sectional view taken along a line A-A in FIG. 1. FIG. 3 is a cross-sectional view taken along a line B-B in FIG. 1. In the XYZ orthogonal coordinate system shown in FIGS. 1 to 3, the X axis is set in the longitudinal direction (front-rear direction) of the transmission line 1, the Y axis is set in the width direction (horizontal direction) of the transmission line 1, and the Z axis is set in the height direction (vertical direction) of the transmission line 1.

As shown in FIGS. 1 to 3, the transmission line 1 includes a post-wall waveguide 10, a waveguide tube 20, and a wire member 30, and transmits a high-frequency signal along a longitudinal direction (X direction) of the transmission line 1. In the present embodiment, for ease of understanding, the case where the transmission line 1 transmits a high-frequency signal in the direction from the −X side to the +X side will be described as an example. However, it is also possible for the transmission line 1 to transmit a high-frequency signal in the direction from the +X side to the −X side. The high-frequency signal transmitted through the transmission line 1 is, for example, a high-frequency signal in the E band (70 to 90 GHz-band).

The post-wall waveguide 10 includes a dielectric substrate 11, a first conductor layer 12*a*, a second conductor layer 12*b*, and a post-wall 13, and an area surrounded by the first conductor layer 12*a*, the second conductor layer 12*b*, and a post-wall 13 is referred to a waveguide region G (FIG. 2). The dielectric substrate 11 is a flat plate-like substrate formed of a dielectric such as glass, a resin, ceramics, or a composite thereof. The dielectric substrate 11 is arranged such that the thickness direction thereof is parallel to the Z axis. The first conductor layer 12*a* and the second conductor layer 12*b* are thin film layers respectively formed on the top and bottom surfaces of the dielectric substrate 11 by conductors such as a metal of copper or aluminum, or an alloy thereof, and the first conductor layer 12*a* and the second conductor layer 12*b* are arranged to face each other with the body substrate 11 interposed therebetween. The first conductor layer 12*a* and the second conductor layer 12*b* can be connected to an external portion so as to have a ground potential. The first conductor layer 12*a* is arranged on the +Z side and the second conductor layer 12*b* is arranged on the −Z side.

The post-wall 13 is a wall member formed by arranging a plurality of conductor posts P penetrating the dielectric substrate 11 and connecting the first conductor layer 12*a* and the second conductor layer 12*b*. Here, the conductor post P is formed by metal plating of copper or the like in a hole portion (through-hole) penetrating the dielectric substrate 11 in the thickness direction (direction along the Z axis), for example. The post-wall waveguide 10 can also be fabricated by processing a double-sided copper-clad laminate plate such as a printed circuit board (PCB).

The post-wall 13 has a pair of first post-walls 13*a* and 13*b* (FIGS. 1 and 3) extending parallel to the longitudinal direction (X direction) of the post-wall waveguide 10 and a second post-wall 13*b* extending in the width direction (Y direction) of the post-wall waveguide 10 (short wall). The pair of first post-walls 13*a* and 13*b* are formed by arranging a plurality of conductor posts P in two rows along the longitudinal direction with a predetermined distance in the width direction. That is, the first post-wall 13*a* is formed by a plurality of conductor posts P aligned in the X direction, and the first post-wall 13*b* is formed of a plurality of conductor posts P arranged in the X direction at positions different in the Y direction from the first post-wall 13*a*. The second post-wall 13*c* is formed by arranging a plurality of conductor posts P in a row between the +X side end portions of the pair of first post-walls 13*a* and 13*b*.

As described above, in the post-wall waveguide 10, a region surrounded by the first conductor layer 12*a* and the second conductor layer 12*b* and the post-wall 13 constitutes the waveguide region G. Therefore, the distance between the plurality of conductor posts P constituting the post-wall 13 is set to a distance at which the high-frequency signal propagating in the waveguide region G does not leak to the outside of the post-wall waveguide 10. For example, the distance between the adjacent conductor posts P, which is a distance between centers (distance between adjacent conductor posts P in the first post-wall 13*a*, distance between adjacent conductor posts P in the first post-wall 13*b*, and distance between adjacent conductor posts P in the second post-wall 13*c*), is desirably set to equal to or less than twice the diameter of the conductor post P. Further, the waveguide region G extends in the X direction.

Here, in the first conductor layer 12*a* constituting a part of the post-wall waveguide 10, for example, an opening H having a circular shape in plan view is formed. The shape of the opening H in plan view may be a shape other than a circular shape (for example, a rectangular shape, a polygonal shape). This opening H is formed at a position separated by a predetermined distance from the second post-wall 13*c* to the −X side in the Y direction of the pair of first post-walls 13*a* and 13*b*. Incidentally, it is desirable that the opening H be formed at a position where the distances (distance in the Y direction) between the opening H and each of the pair of first post-walls 13*a* and 13*b* in the width direction are equal.

As shown by FIG. 1, for example, the waveguide tube 20 includes a pair of upper and lower wide walls (side walls) 21*a* and 21*b*, a pair of left and right narrow walls (side walls) 21*c* and 21*d*, and a narrow wall 21*e* at one end portion (the end on the −X side), and is a hollow rectangular member extending in the X direction. In the waveguide tube 20, a wide wall 21*b* is cut out at one end thereof, and an opening OP (see FIGS. 2 and 3) is formed in the wide wall 21*b*. For example, the wide wall 21*b* is cut out with a width approximately equal to the width of the post-wall waveguide 10 in the central portion in the width direction, and in the longitudinal direction, the opening H formed in the first conductor layer 12*a* is formed at least within the tube and is vertically cut out such that at least the inside of the tube of the waveguide tube 20 is exposed to the outside.

To the waveguide tube 20, the first conductor layer 12*a* of the post-wall waveguide 10 is connected such that the opening OP formed in the wide wall 21*b* is covered and such that the axial direction of the waveguide tube 20 and the extending direction of the waveguide region G of the post-wall waveguide 10 are in the same direction. The waveguide tube 20 extends in the same direction (X direction) to which the waveguide region G of the post-wall waveguide 10 extends and is connected to the waveguide region G of the post-wall waveguide 10 via the opening H formed in the first conductor layer 12*a*. The axial direction of the waveguide tube 20 is a direction parallel to the longitudinal direction of the waveguide tube 20, and the "sidewall" in the present invention refers to a wall portion along the longitudinal direction of the waveguide tube 20.

In particular, as shown in FIG. 2, the post-wall waveguide 10 is attached to the waveguide tube 20 such that an end portion (an end portion close to the second post-wall 13*c*) abuts the wide wall 21*b* and the first conductor layer 12*a* is flush with the inner wall of the wide wall 21*b*. As shown in FIGS. 2 and 3, the first conductor layer 12*a* of the post-wall waveguide 10 is soldered to the narrow walls 21*c*, 21*d*, and 21*e* such that three sides of the opening H are surrounded by the pair of right and left narrow walls 21*c* and 21*d* of the waveguide tube 20 and the narrow wall 21*e* at one end portion.

As shown in FIG. 3, the width of the inside of the tube of the waveguide tube 20 is set to be slightly wider than the distance between the pair of first post-walls 13*a* and 13*b*, and the height of an inner surface of the waveguide tube 20 facing downward is set to be higher than an end portion (upper end) of a wire member 30 which will be described later, as shown in FIGS. 2 and 3. That is, a gap is formed between the inner surface of the waveguide tube 20, which faces downward, and the upper end of the wire member 30. Further, as described above, since the narrow wall 21*e* is soldered to the first conductor layer 12*a*, the inside of the waveguide tube 20 is formed so as to extend in the +X direction from the narrow wall 21*e*. The width and the height of the inside of the waveguide tube 20 are appropriately set according to the desired characteristics of the transmission line 1.

The wire member 30 is a cylindrical-shape member where a first end (lower end) is positioned inside the dielectric substrate 11 via the opening H formed in the first conductor layer 12*a*, and a second end (upper end) is positioned inside the tube of the waveguide tube 20. The wire member 30 is desirably arranged so as to pass through the center portion of the opening H; however, it may be slightly deviated from the center portion. The wire member 30 is formed of a metal such as copper, aluminum, tungsten, or the like. In particular, when strength is required, it is preferable to use the wire member 30 made of tungsten.

The diameter of the wire member 30 is set to an arbitrary diameter according to the required characteristic of the transmission line 1 or according to the required strength (the strength of the wire member 30). The length of the wire member 30 is strictly set to a predetermined length. Therefore, the position of the first end of the wire member 30 inside the dielectric substrate 11 and the position of the second end of the wire member 30 in the tube of the waveguide tube 20 are strictly set. The shape of the wire member 30 may be a shape other than a cylindrical shape (for example, a quadrangular prism shape).

Figure 4:
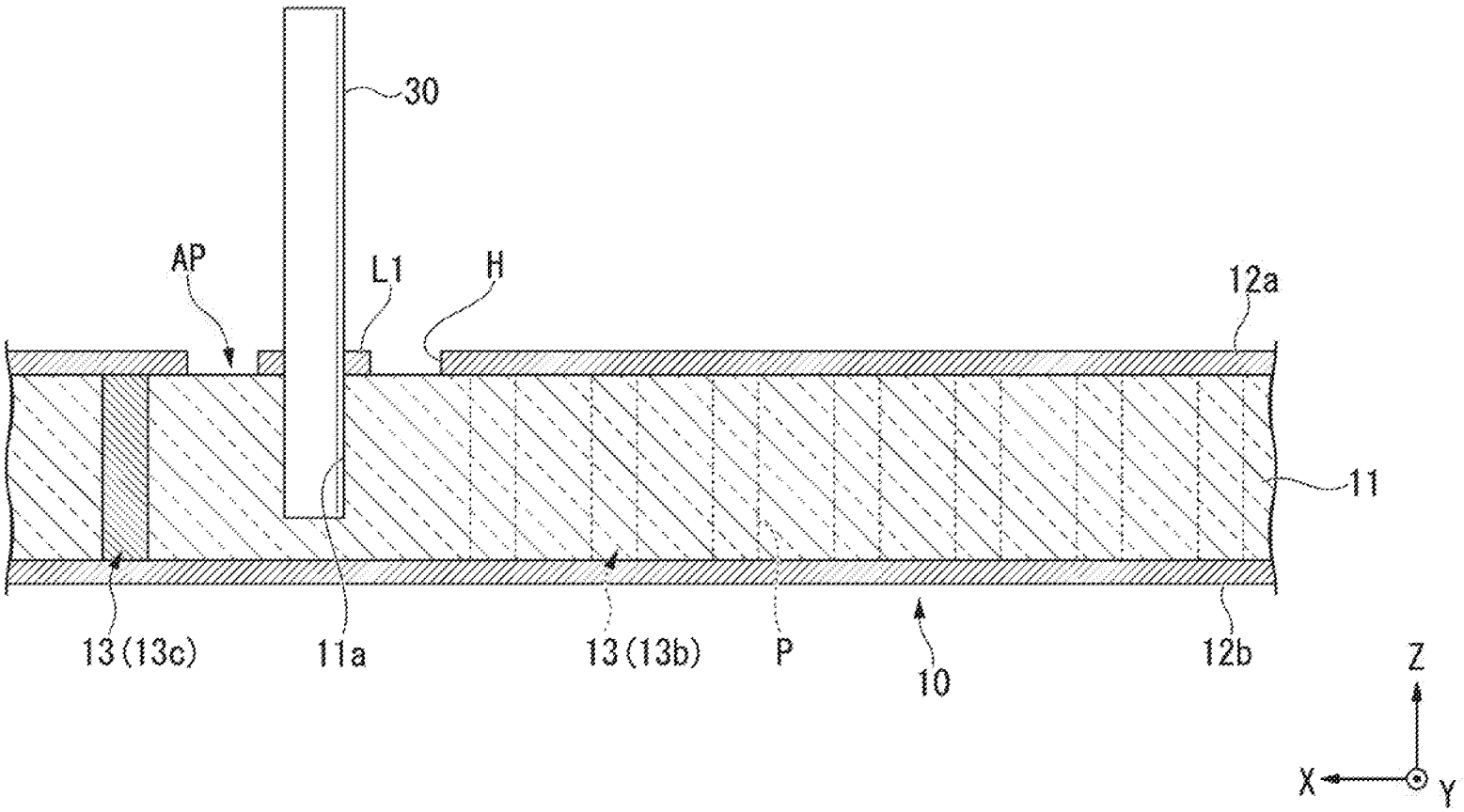
FIG. 4 is an enlarged cross-sectional view of a wire member in FIG. 2.

FIG. 4 is an enlarged sectional view of a wire member according to an embodiment of the present invention. FIG. 4 is an enlarged view of a portion of FIG. 2. As shown in FIG. 4, a hole 11*a* having the same diameter (or approximately the same diameter) as that of the wire member 30 is formed in the dielectric substrate 11 from the opening H side to a part of the thickness direction of the dielectric substrate 11. In the wire member 30, the first end side is inserted through the hole 11*a* formed in the dielectric substrate 11. Therefore, the wire member 30 is provided so as to protrude perpendicularly with respect to the post-wall waveguide 10 from the opening H formed in the first conductor layer 12*a*.

In addition, around the opening portion of the hole 11*a* formed in the dielectric substrate 11, a land L1 is formed in which the inner diameter is the same as the inner diameter of the hole 11*a* (or approximately the same diameter) and the outer diameter is larger than the diameter of the wire member 30. The wire member 30 is inserted through a hole 11*a* formed in the dielectric substrate 11 via the land L1. That is, the land L1 is formed around the wire member 30 in the same plane as the first conductor layer 12*a*. The land L1 is formed by metal plating such as copper, for example. Between the land L1 and the first conductor layer 12*a*, an anti-pad AP having a circular ring shape is formed.

Figure 5:
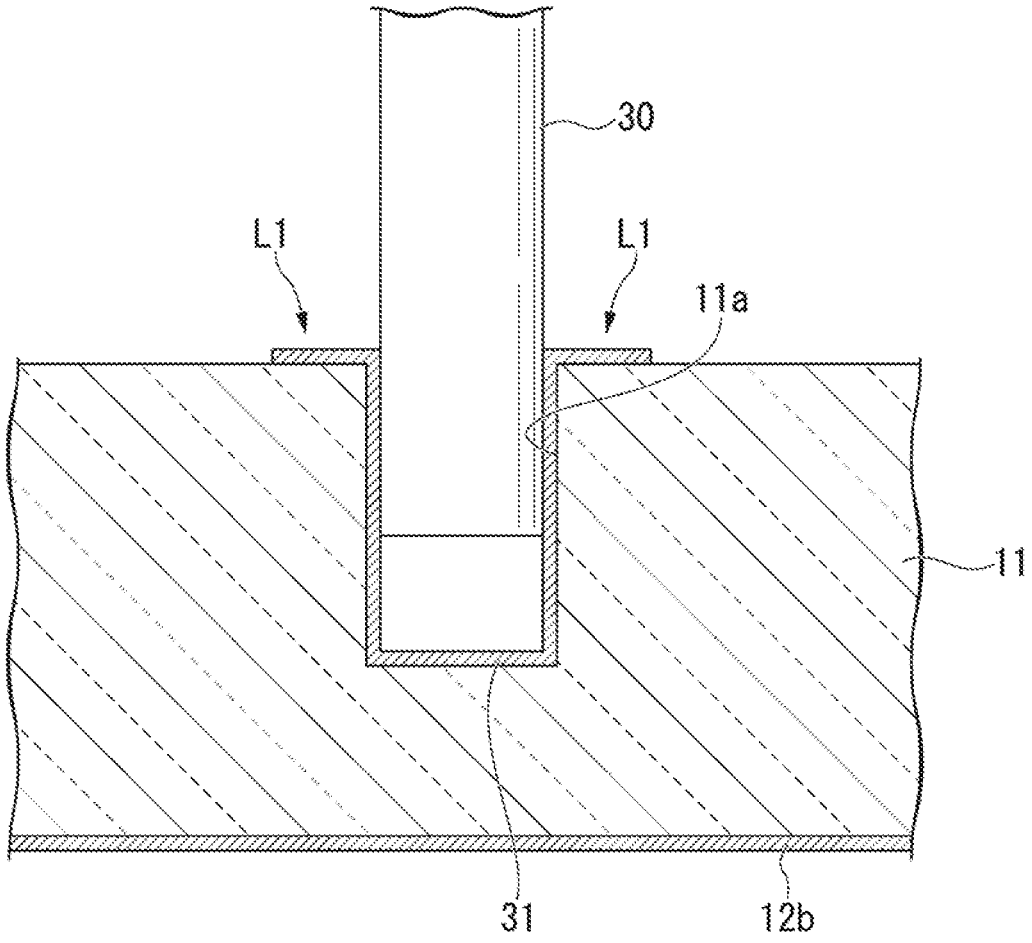
FIG. 5 is a cross-sectional view showing another mounting embodiment of a wire member according to an embodiment of the present invention.

FIG. 5 is a cross-sectional view showing another mounting embodiment of the wire member according to the embodiment of the present invention.

As shown in FIG. 5, in this mounting embodiment, a conductor film 31 having a cylindrical shape which has a closed longitudinal end is formed along the inner wall of a hole 11*a* formed in a dielectric substrate 11, and in the wire member 30, the first end side is inserted into the hole 11*a* where a conductor film 31 is formed. The conductor film 31 is formed so as to extend from the opening portion of the hole 11*a* along the surface of the dielectric substrate 11, and a portion which extends along the surface (plane perpendicular to the thickness direction) of the dielectric substrate 11 is the land L1. The conductor film 31 is formed by metal plating of copper or the like, for example. The conductor film 31 may be formed after an underlayer (underlayer formed of titanium, tungsten or the like) is formed on the inner wall of the hole 11*a*.

Here, the position where the first end of the wire member 30 is to be disposed in the dielectric substrate 11 is predetermined at a position of the bottom portion of the hole 11*a* formed in the dielectric substrate 11. In the mounting embodiment shown in FIG. 4, in order to arrange the first end of the wire member 30 at the above-mentioned predetermined position, the wire member 30 is inserted into the hole 11*a* until the first end of the wire member 30 reaches the bottom of the hole 11*a*.

In contrast, in the present mounting embodiment shown in FIG. 5, the conductor film 31 is formed along the inner wall of the hole 11*a*, and the bottom portion of the conductor film 31 is arranged at the above-described predetermined position. In a state where the wire member 30 is in contact with the conductor film 31, since both are electrically connected, the bottom portion of the conductor film 31 can be regarded as the first end of the wire member 30. For this reason, in the present mounting embodiment, it is not always necessary to insert the wire member 30 through the hole 11*a* until the first end of the wire member 30 reaches the bottom portion of the hole 11*a* as in the mounting form shown in FIG. 4. That is, as shown in FIG. 5, as long as the wire member 30 is in contact with the conductor film 31, the first end of the wire member 30 may not need to reach the bottom surface of the hole 11*a*. As described above, in the present mounting embodiment, the wire member 30 can be easily mounted as compared with the mounting embodiment shown in FIG. 4.

As shown in FIG. 5, in a state in which the first end of the wire member 30 does not reach the bottom surface of the hole 11*a*, there is a possibility that the position of the second end of the wire member 30 in the tube of the waveguide tube 20 (FIG. 1) shifts from the predetermined position. In such a case, for example, a process such as cutting the second end side of the wire member 30 is carried out such that the length of the wire member 30 protruding from the post-wall waveguide 10 (FIG. 1) becomes a predetermined length.

In conjunction with FIG. 1, in the transmission line 1 having the above configuration, the high-frequency signal guided from the −X side to the post-wall waveguide 10 passes through the waveguide region G surrounded by the first conductor layer 12*a* and the second conductor layer 12*b* of the post-wall waveguide 10 and the post-wall 13 (a pair of the first post-walls 13*a* and 13*b*) in the direction from the −X side to the +X side. When the high-frequency signal propagating in the waveguide region G of the post-wall waveguide 10 reaches the position of the wire member 30, the high-frequency signal is guided to the tube of the waveguide tube 20 via the wire member 30. The high-frequency signal guided to the tube of the waveguide tube 20 is radiated into the tube of the waveguide tube 20 from the wire member 30 arranged in a state protruding from the post-wall waveguide 10 in the tube of the waveguide tube 20, and propagates in the waveguide tube 20 in the direction from the −X side to the +X side.

As described above, in the present embodiment associated with respect to FIG. 1, the waveguide tube 20 and the post-wall waveguide 10 are connected such that, through the opening H formed in the first conductor layer 12*a* of the post-wall waveguide 10, the inside of the tube of the waveguide tube 20 and the waveguide region G of the post-wall waveguide 10 communicate with each other. Then, the wire member 30 is arranged via the opening H such that the first end is positioned inside the dielectric substrate 11 and the second end is positioned inside the waveguide tube 20.

Here, the wire member 30 is considered to have a function of once releasing the waveguide mode of the high-frequency signal propagating in the waveguide region G of the post-wall waveguide 10 and then guiding the high-frequency signal to the outside of the post-wall waveguide 10 (inside the tube of the waveguide tube 20) and a function as a starting point forming a waveguide mode in the waveguide tube 20 of the high-frequency signal guided to the outside of the post-wall waveguide 10. With these functions, in the present embodiment, it is considered that reflection loss can be lowered over a wide band.

In the present embodiment, the first conductor layer 12*a* of the post-wall waveguide 10 and the waveguide tube 20 are connected such that the axial direction of the waveguide tube 20 and the extending direction of the waveguide region G of the post-wall waveguide 10 are the same direction. For this reason, if the post-wall waveguide 10 and the bottom portion of the waveguide tube 20 (the respective bottom portions located on the −Z side) are supported by a support portion (not shown), for example, compared to the conventional configuration (configuration in which the waveguide tube is vertically attached to the dielectric substrate forming the post-wall waveguide), it is possible to firmly hold the waveguide tube 20 and the post-wall waveguide 10.

Although the embodiments of the present invention have been described above, the present invention is not limited to the above-described embodiments, and can be freely changed within the scope of the present invention. For example, the following first to third modified examples can be considered.

First Modified Example

Figure 6:
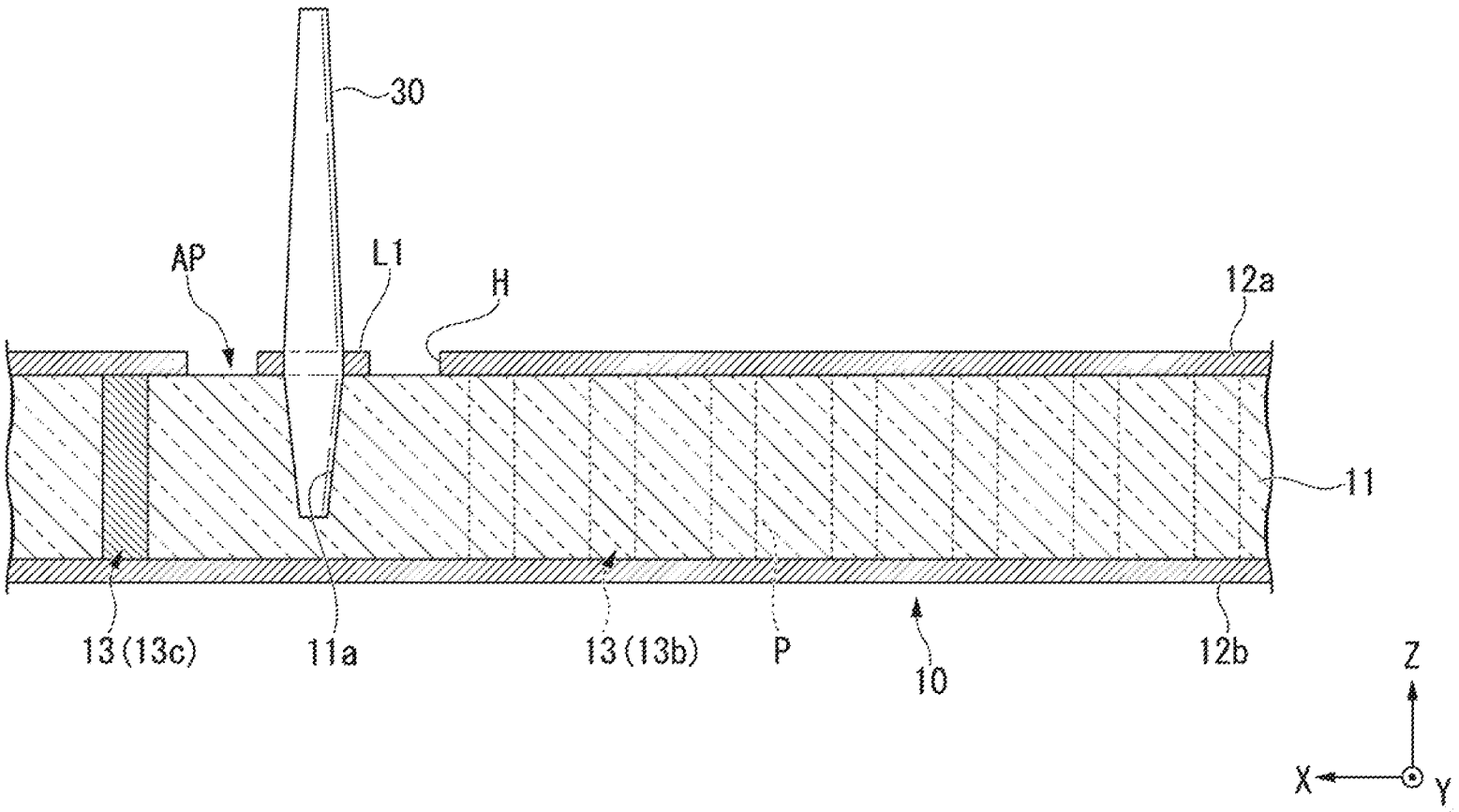
FIG. 6 is a cross-sectional view showing a first modified example of the transmission line according to an embodiment of the present invention.

FIG. 6 is a cross-sectional view showing a first modified example of a transmission line according to an embodiment of the present invention. In FIG. 6, the same members as those shown in FIG. 4 are denoted by the same reference numerals and description may be omitted. In the above-described embodiment, the wire member 30 has a cylindrical shape (or a quadrangular prism shape). However, as shown in FIG. 6, the wire member 30 may be gradually reduced in diameter toward the respective tips on the first end side and the second end side.

By using such a wire member 30, the electric field intensity of the high-frequency signal between the second conductor layer 12*b* of the post-wall waveguide 10 and wire member 30, and the electric field intensity of the high-frequency signal between the wire member 30 and the wide wall 21*a* of the waveguide tube 20 (FIGS. 1-3) can be increased, and thus, it is considered that the reflection loss of the high-frequency signal can be further reduced. It should be noted that in the wire member 30, only the first end side may have a gradually decreasing diameter toward the distal end, and only the second end side may have a gradually decreasing diameter toward the distal end. That is, at least one of the first end side and the second end side may have a gradually decreasing diameter toward the distal end.

Second Modified Example

Figure 7:
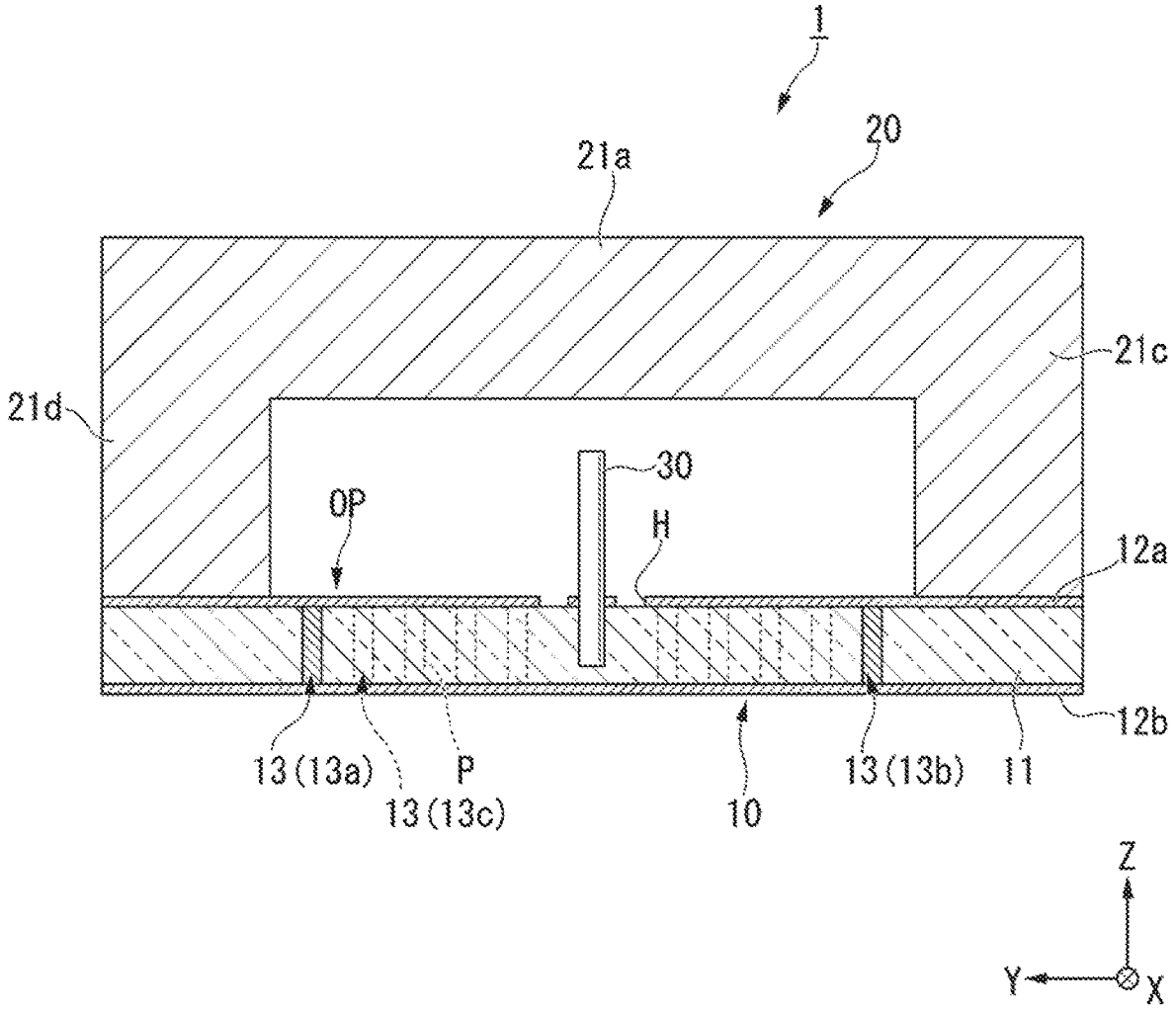
FIG. 7 is a cross-sectional view showing a second modified example of the transmission line according to an embodiment of the present invention.

FIG. 7 is a cross-sectional view showing a second modified example of a transmission line according to an embodiment of the present invention. In the embodiment described above, the width of the waveguide tube 20 is set wider than the width of the post-wall waveguide 10 (see FIG. 3). On the other hand, in the present modified example, as shown in FIG. 7, the width of the waveguide tube 20 and the width of the post-wall waveguide 10 may be the same (or substantially the same). Comparing FIG. 7 to FIG. 3, in the present modified example, the thickness of the left and right pair of narrow walls 21*c* and 21*d* of the waveguide tube 20 is reduced and the width of the waveguide tube 20 and the width of the post-wall waveguide 10 are made the same. It is also possible to set the width of the waveguide tube 20 to be narrower than the width of the post-wall waveguide 10 unless the high-frequency signal propagating in the tube of the waveguide tube 20 leaks to the outside.

Third Modified Example

In the transmission line 1 described in the above embodiment, the direction in which the waveguide region G (FIG. 2) of the post-wall waveguide 10 extends and the axial direction of the waveguide tube 20 are the same. However, the direction in which the waveguide region G of the post-wall waveguide 10 extends and the axial direction of the waveguide tube 20 may intersect (for example, orthogonal) in plan view. That is, when the post-wall waveguide 10 and the bottom portion (bottom portions located on the −Z side) of the waveguide tube 20 are supported by a support portion (not shown), even if the direction in which the waveguide region G of the post-wall waveguide 10 extends and the axial direction of the waveguide tube 20 intersects in plan view, the waveguide tube 20 and the post-wall waveguide 10 can be firmly held as compared with the conventional configuration as in the above-described embodiment (embodiment that the direction in which the waveguide region G of the post-wall waveguide 10 extends and the axial direction of the waveguide tube 20 are the same).

EXAMPLES

The inventor of the present application actually designed and simulated the transmission line having the above-described configuration, and determined the intensity distribution of the high-frequency signal transmitted by the transmission line, and the reflection characteristic and the transmission characteristic of the transmission line. The design parameters of the simulated transmission line 1 are as follows.

(Post-Wall Waveguide 10)

Thickness of dielectric substrate 11: 520 [μm]

Relative permittivity of dielectric substrate 11: 3.82

Distance between first post-walls 13*a* and 13*b* (distance between each center): 1540 [μm]

Distance between second post-wall 13*c* and the wire member 30 (distance between each center): 480 [μm]

Diameter of opening H (anti-pad AP): 620 [μm]

(Waveguide Tube 20)

Height inside tube: 1149 [μm]

Width inside tube: 2500 [μm]

Distance from center of wire member 30 to narrow wall 21*e:* 815 [μm]

(Wire Member 30)

Diameter: 180 [μm]

Protrusion length from the post-wall waveguide 10: 700 [μm]

Length inside post-wall waveguide 10: 420 [μm]

Diameter of land L1: 280 [μm]

Figure 8:
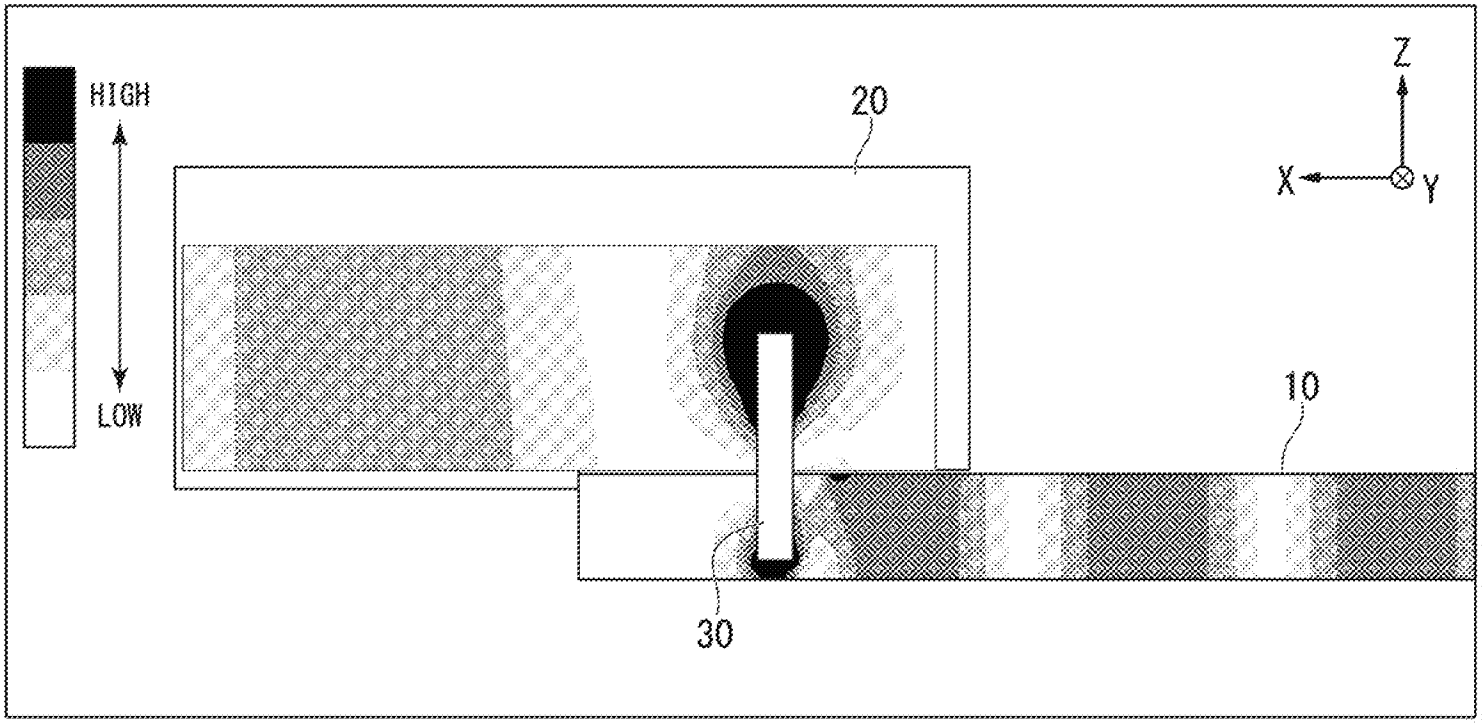
FIG. 8 is a diagram showing a simulation result of an electric field intensity distribution of a high-frequency signal transmitted by a transmission line according to the first example (Example) of the present application.

FIG. 8 is a diagram showing a simulation result of the electric field intensity distribution of the high-frequency signal transmitted by the transmission line according to the examples. In FIG. 8, darker portion indicates higher intensity of the electric field. The simulation result shown in FIG. 8 shows a case where a high-frequency signal of a certain frequency (for example, 80 [GHz]) is guided from the right side (−X side) on a drawing sheet to the post-wall waveguide 10 and transmitted in the left direction (+X direction) on a drawing sheet. The high-frequency signal guided to the post-wall waveguide 10 is guided to the waveguide tube 20 and then transmitted inside the tube of the waveguide tube 20 in the left direction (+X direction) on a drawing sheet.

Referring to FIG. 8, in the right side portion on a paper sheet of the post-wall waveguide 10, the electric field intensity of the high-frequency signal changed in a stripe pattern in the direction from the right side on the drawing sheet to the left side on the drawing sheet (transmission direction). As a result, it was found that the high-frequency signal guided to the post-wall waveguide 10 was transmitted in the transmission direction in a certain mode inside the post-wall waveguide 10. Likewise, the electric field intensity of the high-frequency signal changed in a stripe pattern in the transmission direction also in the left side portion on the drawing sheet of the waveguide tube 20. As a result, it was found that the high-frequency signal guided to the tube of the waveguide tube 20 was transmitted in the transmission direction in a certain mode inside the waveguide tube 20.

Referring to FIG. 8, at the position where the wire member 30 (FIG. 1) of the post-wall waveguide 10 was provided, the electric field intensity of the high-frequency signal did not change in a stripe pattern, and the electric field intensity of the high-frequency signal was significantly increased between the first end of the wire member 30 and the bottom surface (the second conductor layer 12*b*) of the post-wall waveguide 10. Such electric field intensity is considered to be obtained by temporarily releasing the waveguide mode of the high-frequency signal, which propagates in the waveguide region G (FIG. 2) of the post-wall waveguide 10, by the wire member 30.

In addition, referring to FIG. 8, the electric field intensity of the high-frequency signal was also significantly increased between the second end of the wire member 30 and the inner surface (surface facing in the −Z direction) of the waveguide tube 20. In particular, the electric field intensity was significantly increased around the second end portion of the wire member 30, and an elliptical electric field distribution extending in the vertical direction to the upper surface of the waveguide tube 20 was formed. By obtaining such electric field intensity, it is considered that formation of a mode starting from the wire member 30 is performed.

Figure 9:
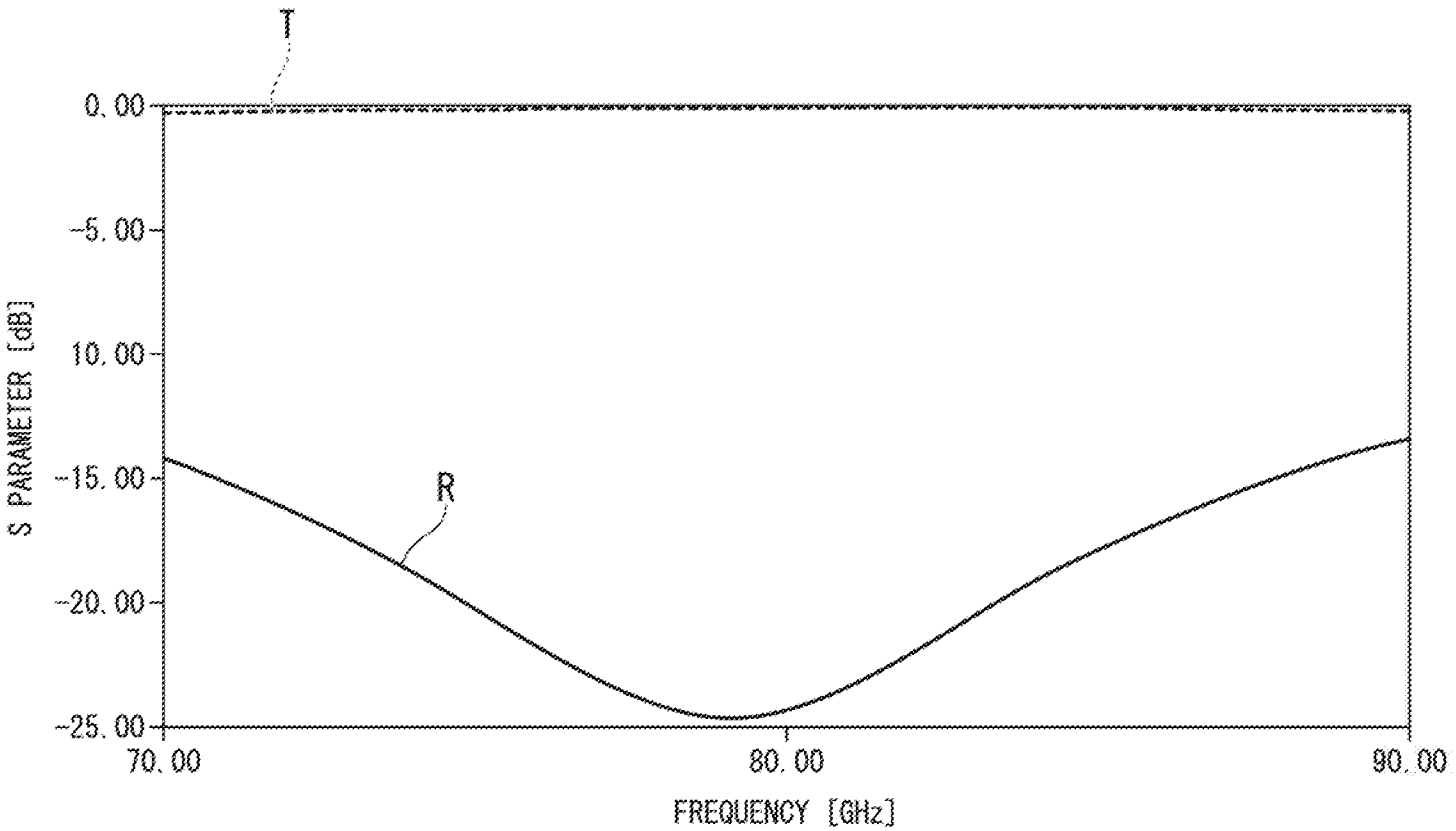
FIG. 9 is a diagram showing simulation results of reflection characteristics and transmission characteristics of a transmission line according to the first example of the present application.

FIG. 9 is a diagram showing simulation results of reflection characteristics and transmission characteristics of the transmission line (i.e., S Parameter in dB vs. Frequency in GHz) according to the example. In FIG. 9, the curve denoted by reference character R is a curve showing the reflection characteristic of the transmission line, and a curve denoted by T is a curve showing the transmission characteristic of the transmission line.

Referring to the curve R in FIG. 9, the band where the S parameter is −15 [dB] or less (band with low reflection loss) was approximately 71 to 88 [GHz]. As described above, it was found that the transmission line according to the present example has a low reflection loss over a wide band, and it is possible to transmit a high-frequency signal of E band (70 to 90 GHz-band), for example, with low loss.

DESCRIPTION OF THE REFERENCE SYMBOLS

1: transmission line, 10: post-wall waveguide, 11: dielectric substrate, 11*a*: hole, 12*a*: first conductor layer, 12*b*: second conductor layer, 13*a*, 13*b*: first post-wall, 20: waveguide tube, 21*b*: wide wall, 30: wire member, 31: conductor film, AP: anti-pad, H: opening, L1: land, OP: opening, G: waveguide region

The invention claimed is:

1. A transmission line, comprising:

a post-wall waveguide which comprises a dielectric substrate on which a pair of post-walls is formed and a first conductor layer and a second conductor layer opposed to each other with the dielectric substrate interposed therebetween, and in which a region surrounded by the pair of post-walls, the first conductor layer, and the second conductor layer is a waveguide region, a waveguide tube having a hollow rectangular shape and having a bottom opening that covers the first conductor layer of the post-wall waveguide, the waveguide tube being connected with the first conductor layer so as to cover the bottom opening by the first conductor layer, and in which an inside of the waveguide tube communicates with the waveguide region through an opening formed in the first conductor layer, and a wire member which is arranged such that through the opening, a first end is located inside the dielectric substrate and a second end is located inside a tube of the waveguide tube, wherein, the wire member is inserted into a hole formed from the opening to a part of the dielectric substrate, a conductor film having a cylindrical shape which has a closed longitudinal end is formed along an inner wall of the hole, the wire member is inserted through the hole in which the conductor film is formed, and at least in one of the first end and the second end of the wire member, a diameter gradually decreases toward a distal end.

2. The transmission line according to claim 1, wherein a land having a larger diameter than the wire member is formed around the wire member in the same plane as the first conductor layer, and an anti-pad is formed between the first conductor layer and the land.

3. The transmission line according to claim 1, wherein an axial direction of the waveguide tube is the same direction as a signal propagation direction of the waveguide region of the post-wall waveguide.

* * * * *